US006070435A

United States Patent [19]

Davidziak

[11] Patent Number: 6,070,435

[45] Date of Patent: Jun. 6, 2000

[54] JEWELRY ARTICLE WITH MOVEABLE APPENDAGES

[75] Inventor: Andre Davidziak, Roselle, N.J.

[73] Assignee: Meyrowitz, Inc., Atlanta, Ga.

[21] Appl. No.: 09/149,936

[22] Filed: Sep. 9, 1998

[51] Int. Cl.[7] ..... A44C 25/00

[52] U.S. Cl. ..... 63/23; 446/376; 446/384

[58] Field of Search ..... 63/23; 446/376, 446/378, 383, 384

[56] References Cited

U.S. PATENT DOCUMENTS

| | | | |
|---|---|---|---|
| 942,524 | 12/1909 | Sneyd . | |
| 1,880,109 | 9/1932 | Sanders | 446/376 |
| 3,699,715 | 10/1972 | Lewis et al. | 446/376 |
| 4,512,748 | 4/1985 | Matsumoto et al. . | |
| 4,581,904 | 4/1986 | Lehmann et al. . | |
| 4,854,911 | 8/1989 | Berliner et al. | 446/376 |
| 4,967,574 | 11/1990 | Bielka . | |

FOREIGN PATENT DOCUMENTS

| | | | |
|---|---|---|---|
| 695174 | 12/1930 | France | 446/376 |

*Primary Examiner*—Terry Lee Melius
*Assistant Examiner*—Andrea Chop
*Attorney, Agent, or Firm*—Akin, Gump, Strauss, Hauer & Feld, L.L.P.

[57] ABSTRACT

A jewelry article, such as a pendant or a charm, includes a hollow body and one or more hollow or solid appendages which are secured to the body by an elongated pin having an integral head and which provides a rotatable hidden joint connection between the body and appendage. The body is cast as a two-part hollow body and one of the parts having one or more bearing pads or surfaces and one or more bores for receiving respective connection pins. The pins each project through a bore in an appendage and each pin is secured to an appendage at a distal end by soldering, for example. The interior cavity of the body is closed by securing a second body part to a first body part by soldering or a suitable adhesive.

9 Claims, 3 Drawing Sheets

JEWELRY ARTICLE WITH MOVEABLE APPENDAGES

FIELD OF THE INVENTION

The present invention pertains to a jewelry article, such as a charm or pendant, having a body and moveable appendages which are connected to the body by a pin-type joint connection.

BACKGROUND

Jewelry articles, such as pendants and charms with moveable appendages, are known and such charms in the form of animals with moveable head and leg appendages are particularly popular. Such articles are relatively small, and are typically cast of precious or semi-precious metals wherein a main body or torso of the article is cast as a hollow body and the appendages, such as head, arms and legs, may also be hollow bodies or, in smaller items, cast as solid parts.

The assembly of such articles can be difficult and the proper retention of the moveable appendages also difficult to accomplish because of the physical size of the articles. For example, the overall height or length of a charm or pendant in the form an animal may be less than 1.0 inches and the length of the appendages no more than 0.25 inches.

Several efforts have been attempted in the prior art to develop suitable connections between the main body portions of charms or pendants and moveable appendages therefor. However, the complexity of the assembly process with some prior art designs including multiple solder points and connections which place undue stress on the joint members has created a need for an improved joint connection between appendages of animal charms or pendants as well as similar jewelry articles which have interconnected parts which are moveable relative to each other. The present invention overcomes the disadvantages of prior art joint connections between parts of jewelry articles, such as animal form pendants and charms, and also meets substantially all of the desiderata for providing reliable and proper joint connections for such articles.

SUMMARY OF THE INVENTION

The present invention provides an improved jewelry article, such as an animal form pendant or charm, which has an improved connection between interconnected parts of the article wherein the parts are moveable relative to each other. In particular, the invention provides an improved joint connection between a main body part and moveable appendages such as a head and legs of an animal form pendant or charm.

In accordance with one aspect of the invention a jewelry article having a main body and one or more moveable appendages is provided wherein the main body is formed as a two-part hollow cast member provided with one or more bearing surfaces for supporting a moveable appendage and wherein each of the appendages is connected to the main body by a pin having a head portion which is retained inside the hollow space of the main body, projects through the appendage, including a bore in the appendage outer wall and is secured to the appendage by suitable means, such as by soldering, or welding from the outside surface of the appendage or by using a suitable adhesive between the pin and the appendage.

In accordance with another aspect of the invention an animal charm or pendant jewelry article is provided with a hollow main body which is formed in two parts. One part includes generally circular bearing pads formed integral therewith or suitably mounted thereon and adapted to support moveable appendages which are connected to the main body by an improved pin-type connection and wherein the bearing pad supports the appendage with respect to the body and reduces certain forces which otherwise would act on the connecting pin.

In accordance with yet another aspect of the invention an animal form pendant, charm or similar jewelry article is provided and having parts which are moveably interconnected wherein a reduced number of assembly operations is required to form a joint connection, including only one soldering, adhesive applying or similar operation to secure a retaining and support pin between two parts of the article.

In accordance with still a further aspect of the present invention, an improved method is provided for connecting the moveable parts of an animal form pendant or charm to each other to provide a connection between such parts which allow easy movement or rotation of the parts relative to each other but also provide a joint connection which is not loosely fitted.

The present invention provides an improved jewelry article which has interconnected parts moveable relative to each other and formed by an improved joint connection and method of assembly. Those skilled in the art will further appreciate the advantages and superior features of the invention as well as other important aspects thereof upon reading the detailed description which follows in conjunction with the drawing.

DETAILED DESCRIPTION OF PREFERRED EMBODIMENTS

Figure 1:
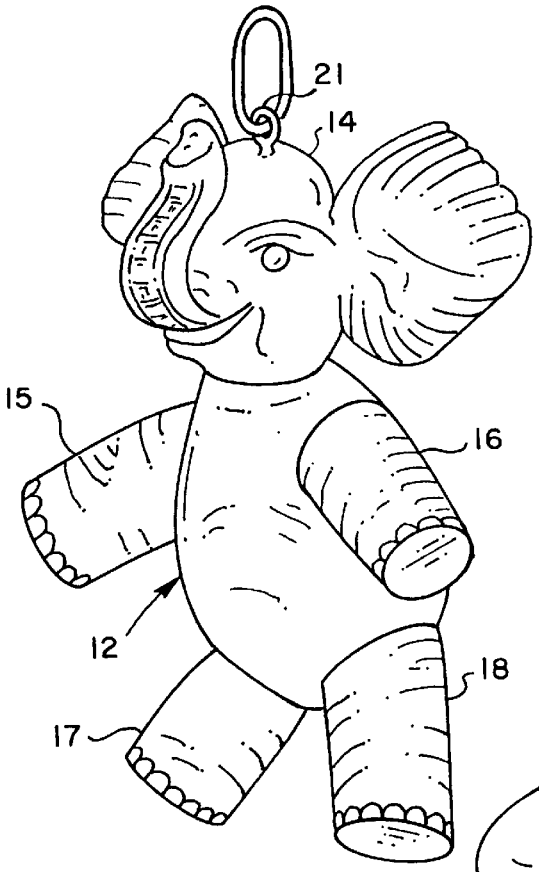
FIG. 1 is a perspective view of a jewelry article comprising an animal form pendant or charm having moveable appendages and in accordance with the present invention.

In the description which follows like parts are marked throughout the specification and drawing with the same reference numerals, respectively. The drawing figures are not necessarily to scale and certain features of the invention may be exaggerated in scale in the interest of clarity and conciseness.

Figure 2:
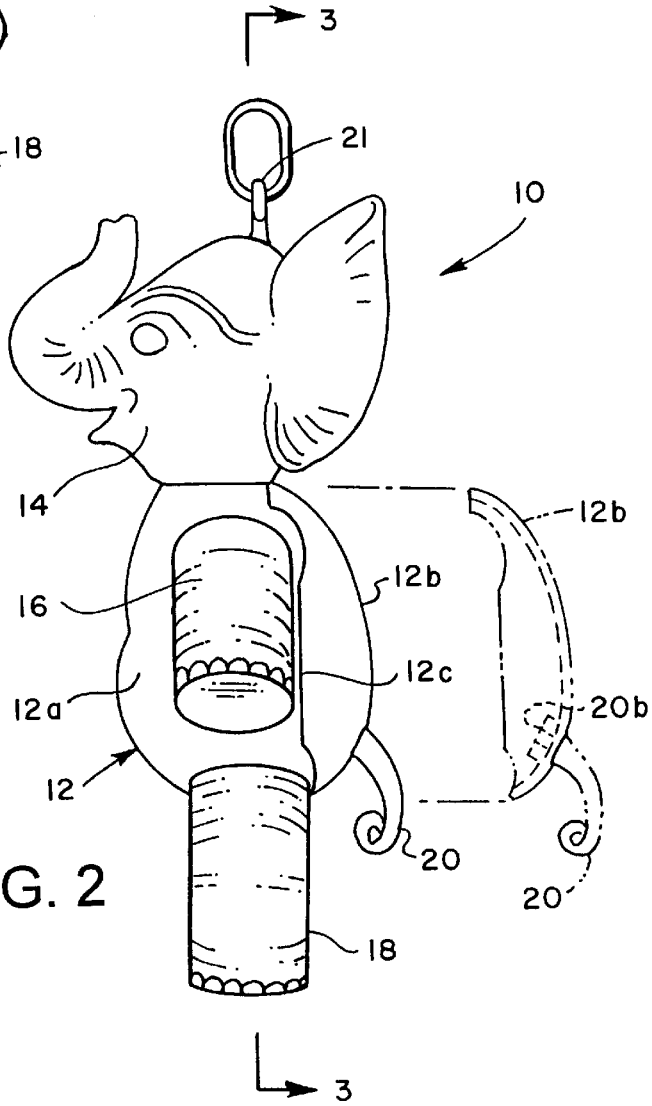
FIG. 2 is a side elevation of the article shown in FIG. 1 showing a removable portion of the body or torso of the article.

Referring to FIGS. 1 and 2, there is illustrated a jewelry or novelty article, generally designated by the numeral 10, which has parts which are interconnected in such a way that they are moveable relative to each other. A particularly preferred embodiment of the jewelry article 10 comprises a pendant or charm having the form of an animal, such as an elephant, as illustrated. The article 10 includes a hollow body 12, preferably cast of a precious or semiprecious metal, to which are connected a head 14, respective front legs 15 and 16 and rear legs 17 and 18. A moveable tail 20 is also connected to the body 12, FIG. 2.

Figure 4:
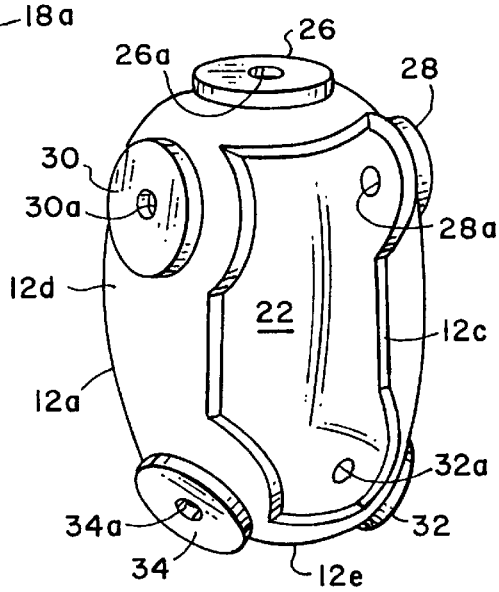
FIG. 4 is a perspective view of the main part of the two-part hollow cast body of the article shown in FIGS. 1 through 3.

As shown in FIG. 2, the body 12 is preferably formed of two separate parts 12*a* and 12*b* which are joined along a continuous parting line 12*c*, see FIG. 4 also, and are suitably secured to each other by the use of an adhesive or by conventional soldering or welding techniques. The body parts 12*a* and 12*b* are typically formed by conventional investment casting methods, for example. The head 14 as well as the legs 15 through 18 may also be fabricated using conventional investment casting methods, particularly if the head and legs are hollow members. The head 14 and the legs 15 through 18 may also be cast or otherwise formed as solid members. However, if the article 10 is formed of a precious metal, such as gold, platinum or silver, for example, all of the body and appendage parts of the article 10 are typically substantially hollow members.

The parting line 12*c* is typically located somewhat off-center of the body 12 for a purpose to be described in further detail herein. The primary plane of the parting line 12*c* is also oriented to be generally parallel to the axis of rotation of the joints which provide for connecting the head 14 and the legs 15 through 18 to the body 12 for movement relative to the body as will be understood from the further description below when read in conjunction with the drawing. To facilitate assembly of the article 10, the above-described arrangement of the parting line 12*c* between the body parts 12*a* and 12*b*, which separates the body 12 into a front part and a rear part, as indicated, is preferable to splitting the body 12 in such a way as to separate the body into a left half and right half or upper and lower parts. This characterization of front, rear, upper and lower is used in the context of an erect body, as illustrated.

Figure 3:
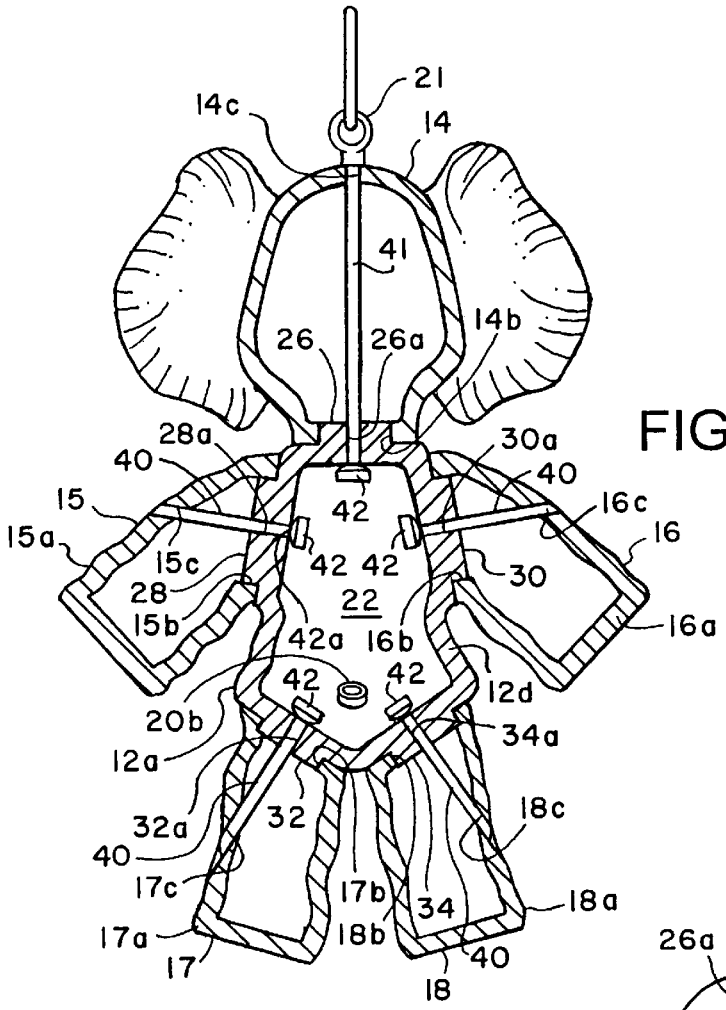
FIG. 3 is a central section view taken generally along the line 3—3 of FIG. 2.

Referring now primarily to FIG. 3, the central section view of FIG. 3 is taken on a plane similar to the plane or general direction of the parting line 12*c*, although the parting line is off-center with respect to a so-called longitudinal central axis of the body 12. The body part 12*a* is configured to form a cavity 22 and includes a continuous outer wall 12*d* on which is preferably formed a first generally circular disc shaped bearing pad 26 which may be integrally formed with the body part 12*a* or separately formed and secured to an outer surface on the body part 12*a*, see FIG. 4 also. The body part 12*a* also includes opposed generally cylindrical disc shaped bearing pads 28 and 30 at the front shoulders for the legs 15 and 16. Generally opposed disc shaped bearing pads 32 and 34 are formed at a hind part 12*e* of the body part 12*a* for connection to the hind legs 17 and 18. All of the bearing pads 26, 28, 30, 32 and 34 may be integrally formed with the body part 12*a*, or separately formed and joined to the body part. The bearing pads described above may also be formed as part of or secured to the appendages 14 through 18 or essentially omitted altogether if the appendages are cast as solid members, for example. FIG. 4 illustrates further details of how the body part 12*a* may be formed to have the off-center parting line 12*c* for the back cover 12*b* oriented so that the bearing pads 26, 28, 30, 32 and 34 may be formed as complete cylindrical or disc shaped members, as shown.

As shown in FIGS. 3 and 4, a generally cylindrical bore 26*a* is formed in the bearing pad 26, generally centrally thereon and extending through the wall 12*d* of the body part 12*a*. In this regard also bores 28*a*, 30*a*, 32*a* and 34*a* extend through the respective bearing pads 28, 30, 32 and 34 also centrally located thereon, as indicated and open into cavity or space 22. Each of the appendages in the form of the head 14 and the legs 15 through 18 is secured to the body part 12*a* by an improved connection which allows rotation of these appendages with respect to the body 12.

Figure 3A:
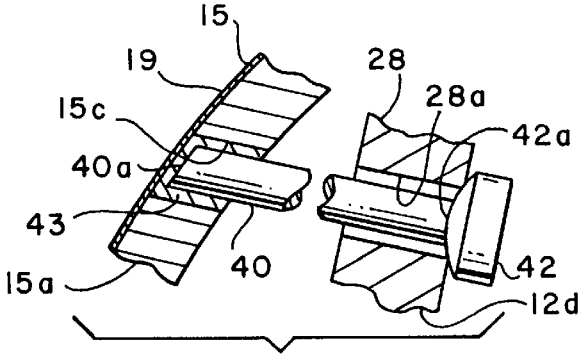
FIG. 3A is a detail view on a larger scale of a joint connection between the article body, a connecting pin and an appendage.

Referring further to FIG. 3 and FIG. 3A, by way of example, the hollow cast leg 15 is defined by a continuous wall 15*a* and a cylindrical opening 15*b*, FIG. 3, at the upper end of the leg which forms a bearing bore to provide for supporting the leg 15 on the bearing pad 28. Moreover, the leg 15 is retained in assembly with the body part 12*a* by an elongated pin 40 having preferably, a hemispherical shaped head portion 42 with a hemispherical surface 42*a* engageable with the wall 12*d*. The pin 40 extends through bore 28*a* and through a bore 15*c* formed in the wall 15*a* and generally aligned substantially co-axially with the bore or opening 15*a* in the appendage 15.

The distal end 40*a* of the pin 40 is preferably generally co-planar with or slightly recessed from the outer surface of wall 15*a*, as shown in FIG. 3A, and the distal end 40*a* is secured to the wall 15*a* by a suitable adhesive or by a solder layer 43, as indicated in FIG. 3A, and applied from the outside surface of the appendage. In this regard the diameter of the pin 40, preferably, is slightly less than the bore 15*c* to allow solder flow between the surfaces of the pin and the bore wall. Other means of securing the distal end 40*a* of the pin 40 to the wall 15*a* of the appendage 15 may be provided. A suitable adhesive, such as a thermosetting adhesive, may be used. The pin end 40*a* may be upset to secure it to the wall 15*a* or be dimensioned for a force fit in bore 15*c*. However, given the physical size and materials of an article usually contemplated for the present invention, a soldering operation is preferred.

The appendages 16, 17 and 18 are secured to the body 12 in the same manner as the appendage 15 also using pins 40, as indicated, and wherein the pins 40 project through bores 16*c*, 17*c* and 18*c* in the walls 16*a*, 17*a* and 18*a* of the respective appendages in the same manner as described for the appendage 15. The pins 40 may be of a sufficient length to fit all of the appendages and cut to length, including scarfed distal ends, as necessary. Appendages 16, 17 and 18 include cylindrical openings or bearing bores 16*b*, 17*b* and 18*b* for receiving bearing pads 30, 32 and 34 respectively.

In like manner a pin 41 secures the head appendage 14 to the body 12 and wherein the pin 41 has a head portion 42, and the pin projects through bore 26*a* and a bore 14*c* in appendage wall 14*a* aligned with the bore 26*a*. A bearing bore or opening 14*b* is provided for engagement with pad 26. An eye 21 is suitably secured to appendage 14 offset from the bore 14*c*, and the axis of rotation of the appendage with respect to the body part 12*a*. The bores 14*c*, and 15*c* as well as the corresponding bores 16*c*, 17*c* and 18*c* for the appendages 16, 17 and 18 may be formed at the time of casting these parts.

The cylindrical openings or bearing bores 14*b* through 18*b* are also formed when the respective parts 14 through 18 are cast in accordance with one preferred method of fabricating the jewelry article 10. Although the bores 26*a*, 28*a*, 30*a*, 32*a* and 34*a* may be formed at the time of casting the body part 12*a*, these bores may also be formed at a later time by a drilling operation or the like.

Assembly of the jewelry article 10 may be carried out substantially as follows. After casting each of the parts 12*a*, 12*b* and 14 through 18, the castings are deburred and trimmed, as needed, and the respective pin receiving bores checked for proper sizing. Each appendage 14 through 18 may then be attached to the body part 12*a* by mounting the appendage on its associated disc shaped bearing pad. The appendages are then attached to the body part 12*a* by projecting a pin 40 or 41 through the body part from the cavity or space 22 and through the pin receiving bore on the associated appendage. For example, upon mounting the appendage or leg 15 on the bearing pad 28, a pin 40 is inserted from within the cavity 22 through the bore 28*a* and into the bore 15*c*. While the appendage 15 is held in assembly with the body part 12*a* and the pin 40, the pin is secured to the appendage by soldering the distal end 40*a* of the pin to the appendage wall 15*a* at bore 15*c* from the exterior of the appendage to provide the arrangement shown in FIGS. 3 and 3A. The pin 40 may be precut to length or cut or ground flush with the outer surface of wall 15*a* at assembly.

After each of the other appendages 14 and 16 through 18 is attached to the body part 12*a*, generally as described above for the attachment procedure for the appendage 15, the tail 20 may be attached by projecting a spigot portion of the tail, not shown, through a suitable bore in the body part 12*b* and securing the tail with a retainer collar 20*b*, FIGS. 2 and 3, in a suitable manner. Other means of securing the tail 20 to the body 12 may be provided.

By providing the pin head 42 to have a generally hemispherical surface 42*a* each of the pins 40 and 41 are somewhat self-aligning and there is a tendency to reduce any stress on or bending of the pins as they are inserted into the pin receiving bores in body par 12*a* and the pin receiving bores in the respective appendages. The same arrangement is, of course, advantageously used for all of the appendages 14 through 18 for the exemplary article 10.

After all of the appendages are assembled to the body part 12*a*, the body part 12*b* is assembled to the body part 12*a* by a suitable adhesive or by soldering the two body parts together along the parting line 12*c*. The fabrication of the jewelry article 10 may then be completed by applying a suitable coating or plating 19, FIG. 3A over the exterior surfaces of the body 12 and the appendages 14 through 18 and 20 to conceal the parting line and respective joint connection pin distal ends.

Figure 5:
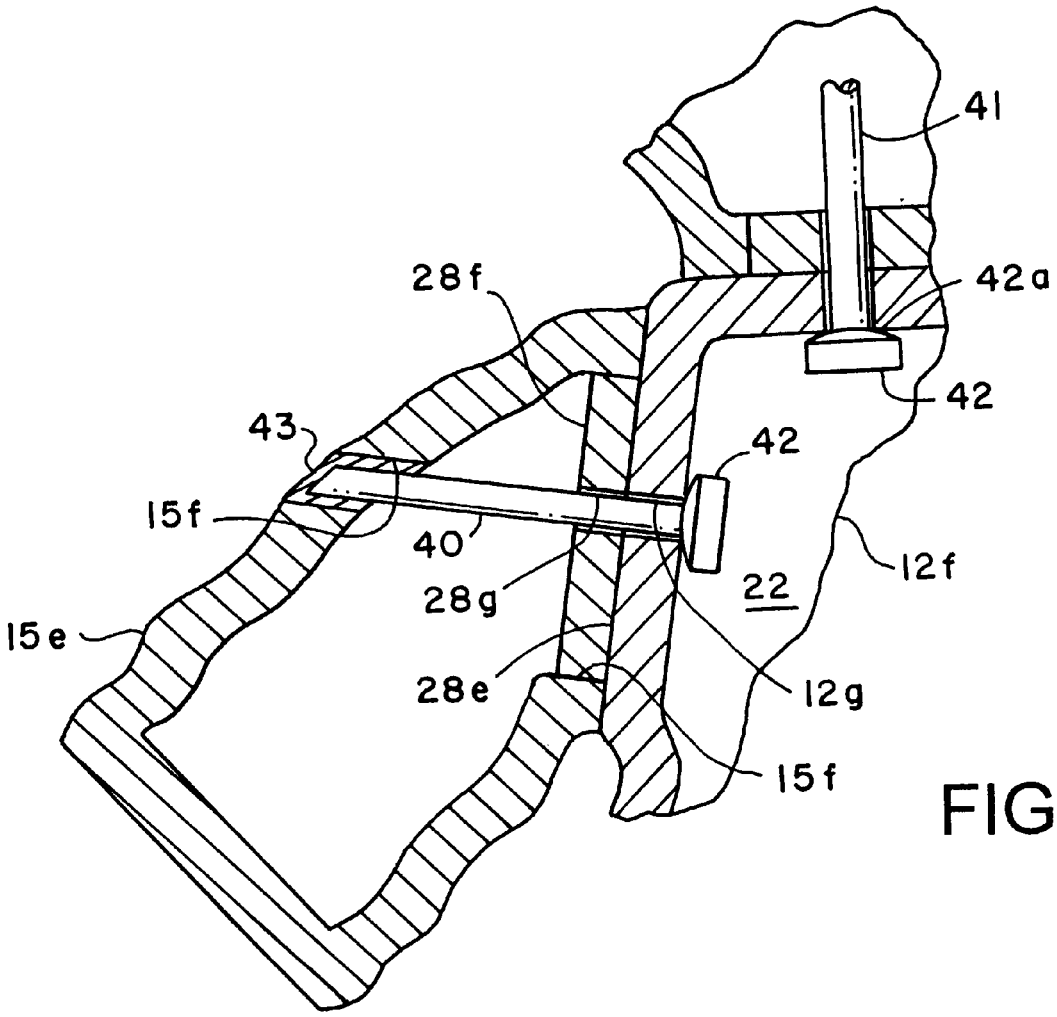
FIG. 5 is a detail section view of a first alternate embodiment showing a modified configuration of a joint connection between a main body portion and an appendage of a jewelry article in accordance with the invention.

Referring now to FIG. 5, an alternate embodiment of a joint connection between a body of a jewelry article and an appendage is illustrated. In FIG. 5 an exemplary joint between a modified body part 12*f* and a modified appendage 15*e* is illustrated. In the embodiment of FIG. 5 the body part 12*f* does not include an integral or fixed bearing pad for each appendage but a generally planar bearing surface 28*e*, for example, is provided and a separate circular disc-shaped bearing pad 28*f* is provided and secured to the appendage 15*e* at a bore 15*f* formed therein in place of the bore 15*a*. A pin 40 is still used to secure the appendage 15*e* to the body 12*f* in the same manner as described for the embodiment illustrated in FIGS. 1 through 4. Each of the other appendages may be secured to the body part 12*f* in substantially the same manner. Moreover, the pin 40 may be modified to provide a generally cylindrical disc-shaped head, not shown in place of the head 42, if desired, although the hemispherical head 42 provides for easier alignment of the pin as it projects through the respective bores 12*g*, 28*g* and 15*f* in the body part 12*f*, the bearing pad 28*f* and the appendage 15*e*, respectively.

Figure 6:
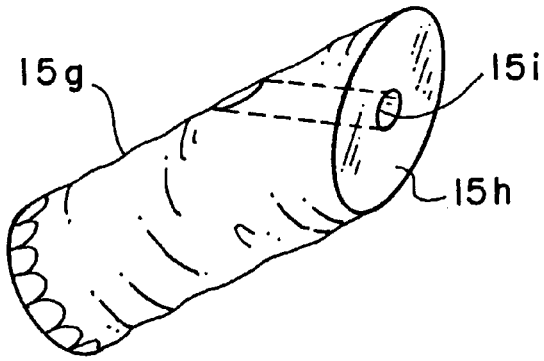
FIG. 6 is a perspective view of a second alternate embodiment of an appendage for a jewelry article in accordance with the invention.

Still further, as illustrated in FIG. 6, the appendage 15*e* may be replaced by a solid cast appendage 15*g* having a bearing surface 15*h* formed thereon and a bore 15*i* extending from the surface 15*h* to an outside surface of the solid appendage so that a pin 40 may project through the bore 15*i* and be suitably soldered at its outer distal end to the solid appendage 15*g*.

The embodiments illustrated in conjunction with FIGS. 5 and 6 enjoy the benefits of the improved joint connection described wherein a pin with an integral head is provided which projects from an interior cavity or space of the charm body to the exterior of each appendage whereupon the pin is easily secured by a single soldering or other operation for the pins, respectively, to the respective appendages.

The fabrication of the jewelry article 10, apart from the steps described herein, may be carried out using conventional techniques for cast metal and other types of jewelry articles which have interconnected parts that are moveable relative to each other. Moreover, while the invention has been illustrated and described for the fabrication of a pendant or charm in the form of an animal, articles of other forms or shapes may be fabricated using the features of the invention and various modifications and constructions may be implemented without departing from the scope and spirit of the appended claims.

What is claimed is:

1. A jewelry article comprising:

a hollow body including an exterior wall and an interior cavity and at least one pin receiving bore extending through said exterior wall;

an appendage attached to said body at an attachment location for rotation with respect to said body without disconnection therefrom, said appendage including an appendage wall having an outer surface and a pin receiving bore formed therein aligned with said pin receiving bore in said body, said pin receiving bore in said appendage opening to said outer surface of said appendage wall opposite said attachment location; and a pin having a head portion and a distal end and insertable in said pin receiving bore in said body from said interior cavity and into said pin receiving bore in said appendage, said distal end of said pin being secured to said appendage at an intersection of said pin receiving bore in said appendage with said outer surface of said appendage wall while allowing rotation of said appendage with respect to said body without disconnecting therefrom.

2. The article set forth in claim 1 wherein:

said article includes a bearing pad extending within a bearing bore in said appendage for supporting said appendage for rotation relative to said body without disconnecting therefrom.

3. The article set forth in claim 2 wherein:

said pin receiving bore in said appendage is substantially co-axially aligned with said bearing bore for aligning said appendage to rotate about said bearing pad.

4. The article set forth in claim 2 wherein:

said bearing pad is disposed on said body.

5. The article set forth in claim 4 wherein:

said bearing pad is cast integral with said body.

6. The article set forth in claim 1 including:

a quantity of bonding agent selected from the group consisting of solder, weld metal and an adhesive for securing said distal end of said pin to said appendage at said intersection of said pin receiving bore in said appendage with said outer surface of said appendage wall.

7. The article set forth in claim 1 wherein:

said body includes a first body part including said pin receiving bore in said body, and said body includes a second body part adapted to be secured to said first body part along a parting line so as to provide access to said interior cavity during assembly of said body to said appendage.

8. The article set forth in claim 1 wherein:

said body includes a bearing surface formed thereon and said appendage includes a bearing pad secured thereto and having a bore aligned with said pin receiving bore in said appendage for receiving said pin for connecting said appendage to said body for rotation of said bearing pad with respect to said bearing surface on said body without disconnection of said appendage from said body.

9. The article set forth in claim 8 wherein:

said bearing pad of said appendage is formed integral with said appendage and comprises a bearing surface of said appendage and said pin receiving bore in said appendage extends from said bearing surface of said appendage to said outer surface of said appendage wall for receiving said pin.

* * * * *